US006719061B2

(12) United States Patent
Muller et al.

(10) Patent No.: US 6,719,061 B2
(45) Date of Patent: Apr. 13, 2004

(54) APPARATUS AND METHOD FOR INSERTING AND RETRIEVING A TOOL STRING THROUGH WELL SURFACE EQUIPMENT

(75) Inventors: Laurent E. Muller, Sugar Land, TX (US); Larry L. Grigar, East Bernard, TX (US); Steven W. Henderson, Katy, TX (US); Klaus B. Huber, Sugar Land, TX (US); Bennie C. Gill, Fulshear, TX (US); Rolf Ludolf, Sugar Land, TX (US); Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 10/165,444

(22) Filed: Jun. 7, 2002

(65) Prior Publication Data

US 2002/0185276 A1 Dec. 12, 2002

Related U.S. Application Data

(60) Provisional application No. 60/296,687, filed on Jun. 7, 2001.

(51) Int. Cl.[7] ..... E21B 34/06

(52) U.S. Cl. ..... 166/373; 166/332.5; 166/242.6; 166/380; 166/386

(58) Field of Search ..... 166/373, 332.3, 166/332.5, 334.2, 321, 115, 381, 242.6, 380, 386, 63

(56) References Cited

U.S. PATENT DOCUMENTS 5,848,646 A 12/1998 Huber et al.
5,950,733 A * 9/1999 Patel ..... 166/373
5,957,209 A * 9/1999 Burleson et al. ..... 166/380
5,992,523 A * 11/1999 Burleson et al. ..... 166/297
6,059,042 A 5/2000 Huber et al.
6,085,845 A * 7/2000 Patel et al. ..... 166/373
6,328,111 B1 12/2001 Bearden et al.

FOREIGN PATENT DOCUMENTS

EP 0 962 625 A2 12/1999
GB 2312226 A 10/1997

OTHER PUBLICATIONS

Halliburton Energy Services, *Ratchet/AutoLach Connectors,* promotional material., undated but after Mar., 2000.

Baker Hughes Inc., *Design of the Gun Connector,* promotional material, undated.

* cited by examiner

*Primary Examiner*—Roger Schoeppel
(74) *Attorney, Agent, or Firm*—Trop, Pruder & Hu, P.C.; Jeffery E. Griffin; Brigitte Jeffery Echols

(57) ABSTRACT

Well surface equipment is provided to seal around the outer surface of portions of tool sections as the tool sections are assembled or disconnected in a portion of the well surface equipment. The portion of the well surface equipment is isolated from wellhead pressure to enhance well operator control during assembly or disassembly of a tool string. Also, if a fluid path is opened up due to activation of the tool string (such as initiation of a detonating cord that is placed in the fluid path), a barrier mechanism is actuated to block fluid communication through this fluid path so that a portion of the well surface equipment can remain isolated from wellhead pressure to enable convenient retrieval and disconnection of tool sections.

27 Claims, 13 Drawing Sheets

APPARATUS AND METHOD FOR INSERTING AND RETRIEVING A TOOL STRING THROUGH WELL SURFACE EQUIPMENT

CROSS REFERENCE TO RELATED APPLICATIONS

This claims the benefit under 35 U.S.C. §119(e) of U.S. Provisional Application Ser. No. 60/296,687, entitled "Apparatus and Method for Blocking the Detonation Cord Path of a Downhole Tool After Detonation," filed Jun. 7, 2001.

TECHNICAL FIELD

This invention relates generally to tools used in downhole environment. More specifically, this invention relates to deploying and retrieving tool sections of a tool string through well surface equipment, with connection and disconnection of the tool sections occurring in a portion of the well surface equipment that is isolated from wellhead pressure.

BACKGROUND

In deploying tools in a wellbore, the tools are usually assembled into a relatively long string, with the string run into the wellbore. In one example, the string is a perforating string having a number of perforating guns attached in series, along with other components.

For efficient assembly and disassembly of a tool string, well surface equipment is provided to maintain the wellbore under pressure while tool sections are being connected and disconnected. One such well surface equipment is the Completions Insertion and Retrieval under Pressure (CIRP) system made by Schlumberger Technology Corporation. In the CIRP system, a connector assembly that cooperates with rams in the well surface equipment is used for connecting and disconnecting tool sections while the wellbore is maintained at pressure. The CIRP system allows wellbore pressure to be maintained up to around 7,000 psi while still allowing assembly and disassembly of tool string sections at the well surface.

In some applications, it may be desirable to further increase the wellbore pressure at the wellhead. At some point, however, the increased pressure at the wellhead makes it difficult to manipulate a tool section in the well surface equipment. This is due to the fact that an operator has to control the tool section in the presence of an upward force provided by the wellhead pressure. As a result, in applications with elevated wellhead pressure (e.g., greater than 7,000 psi), assembly and disassembly of a tool string at the wellhead can be difficult.

For example, if coiled tubing is used to deploy a tool section, the force required to move the tool section and overcome the wellhead pressure can be so high that the operator cannot control the tool section sufficiently to conduct precise connection operations. For instance, a typical 1.75 inch diameter coiled tubing has approximately a 2.4 square inch cross-sectional surface area. If the wellhead is pressurized to 10,000 psi, the operator would have to apply at least 24,000 pounds of force to move the tool section, which makes precise operations very difficult.

SUMMARY

In general, an improved method and apparatus is provided to isolate a portion of the well surface equipment to enable easier assembly or disassembly of a tool string at the wellhead. For example, a method of deploying a tool string includes inserting a first tool into a wellbore through well surface equipment, the wellbore being at an elevated pressure, and isolating a first portion of the well surface equipment from the elevated wellbore pressure. A second tool is connected to the first tool in the portion of the well surface equipment that is isolated from the elevated wellbore pressure, the first tool and second tool making up at least part of the tool string. The tool string has an inner bore, and the inner bore is opened to fluid communication in response to activation of the tool string, such as by detonation of an explosive detonating cord. A barrier mechanism is provided in the tool string to block one portion of the inner bore from another portion of the inner bore to maintain isolation of the first portion of the well surface equipment even after activation of the tool string.

Other or alternative features will be apparent from the following description, from the drawings, and from the claims.

DETAILED DESCRIPTION

Figure 1:
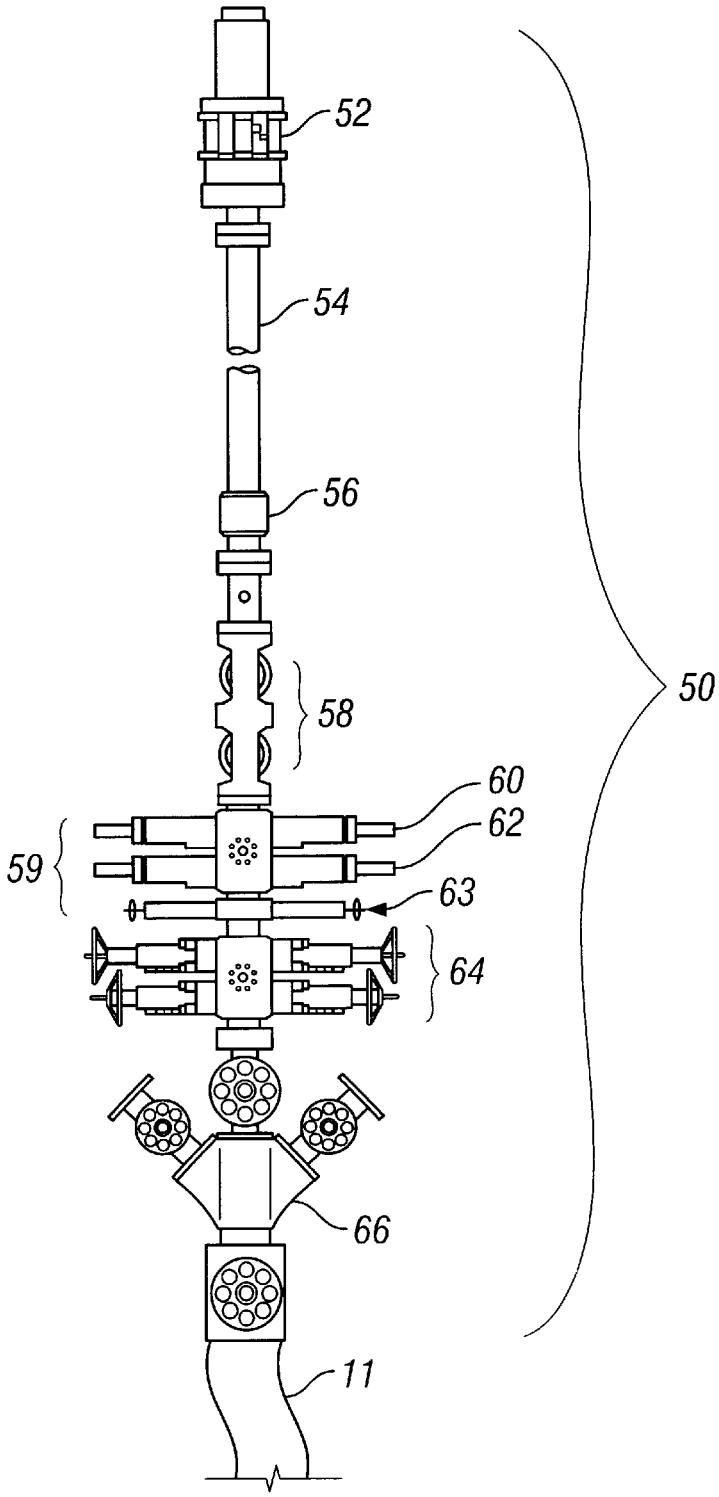
FIG. 1 is a schematic of well surface equipment according to one embodiment.

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in environments that are deviated or horizontal, such terms may refer to a left to right, right to left, or other relationship as appropriate.

In accordance with some embodiments of the invention, well surface equipment 50 is positioned at the top end of a wellbore 11. The well surface equipment 50 includes a stripper 52 that seals around a conveyor of a tool string as the conveyor is run through the stripper 52. In one example, the conveyor is a coiled tubing, and the stripper 52 is a coiled tubing stripper. In other embodiments, other types of conveyors (e.g., wireline, slickline, etc.) can be used. Below the stripper 52 is attached a lubricator (also referred to as a riser) 54 that includes a chamber into which a tool string section can be inserted during assembly. During disassembly, tool string sections are removed from the lubricator 54.

The lower end of the lubricator 54 is attached to a quick connector 56, which enables convenient and quick release of the lubricator 54 from the remainder of the well surface equipment 50 below the quick connector 56. Gate valves 58 are provided between the quick connector 56 and a deployment stack 59. The gate valves 58 are actuated to a closed position to shut in the wellbore 11 below the gate valves 58.

The deployment stack 59 includes a guide ram mechanism 60, a "no-go" ram mechanism 62, and an isolation ram mechanism 63. The deployment stack 59 cooperates with a connector assembly (49, described below) to connect or disconnect tool string sections. The connector assembly 49 has two segments: a lower segment and an upper segment. The no-go ram mechanism 62 locks the lower segment of the connector assembly 49 in position, while the guide ram mechanism 60 activates a lock to connect the upper segment of the connector assembly 49 to the lower segment. Also, according to some embodiments, the isolation ram mechanism 63 seals around a tool string section, such as at a connector assembly 49 attached to the tool string section, to isolate wellhead pressure from the lubricator 54. By isolating the wellhead pressure, operator manipulation of tool sections in the lubricator 54 can be more precise and convenient. Without pressure isolation provided by the isolation ram mechanism 63, wellhead pressure is communicated into the lubricator 54. As noted above, high wellhead pressure (e.g., greater than 7,000 psi) creates a large opposing force that makes tool section manipulation difficult.

A blow-out preventer (BOP) 64 is attached below the deployment stack 59. Below the blow-out preventer 64 is wellhead equipment 66. Note that the arrangement shown in FIG. 1 is provided for purposes of example, as other arrangements are possible in other embodiments.

In the ensuing discussion, it is assumed that the tool string that is deployed in the wellbore 11 is a perforating string having plural perforating guns. However, note that other types of tool strings can be deployed in other embodiments. In the example shown in FIG. 2, a perforating gun string 6 (having plural perforating guns 8) is assembled at the well surface and inserted, section-by-section, into the wellbore 11 through the well surface equipment 50.

As noted above, while the perforating guns 8 of the gun string 6 are being connected and disconnected, it is desirable to isolate the wellhead pressure from the gun string section that is either being added to or removed from the gun string. Connector assemblies 49, which are used to connect gun sections 8 in the string 6, cooperate with the deployment stack 59 to isolate the wellhead pressure from the lubricator 54.

Figure 2:
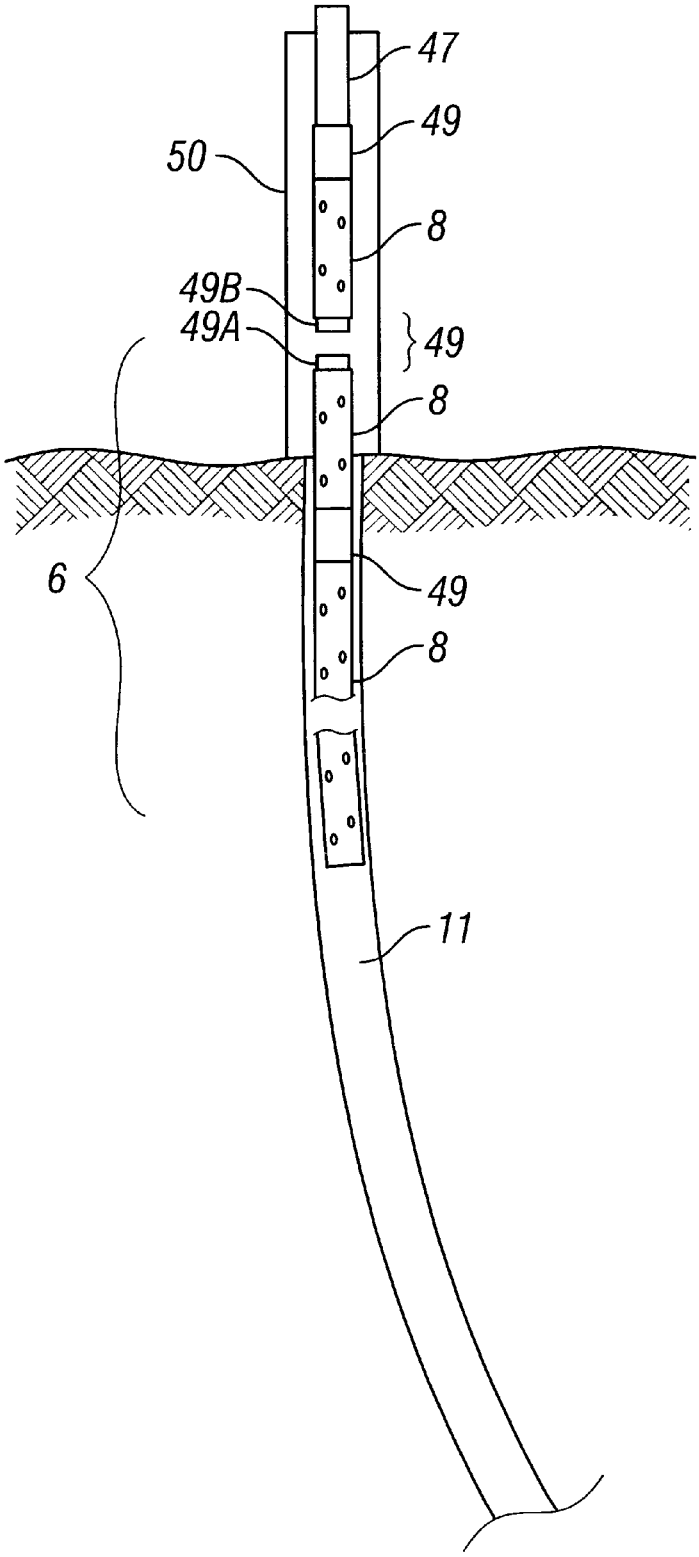
FIG. 2 is a schematic of a gun string deployed in a wellbore through well surface equipment.

For the deployment operation illustrated by FIG. 2, it is assumed that a connector assembly 49 (and the gun string that is already attached to the lower end of the connector assembly 49) has been lowered by a running tool, and such connector assembly 49 is already secured within the well surface equipment by the no-go ram mechanism 62 of the deployment stack 59 (FIG. 1). The connector assembly 49 includes a lower segment 49A and an upper segment 49B. The no-go ram mechanism 62 suspends and locks the lower segment 49A and internal mechanisms prevent the rotation of the lower segment 49A.

After the lower segment 49A of the uppermost connector assembly 49 in the string 6 is engaged in the no-go ram mechanism 62, the next gun 8 (with the lower segment 49B of the connector assembly 49 attached at its lower end) is inserted into the lubricator 54. The upper segment 49B is lowered into the lower segment 49A. The guide ram mechanism 60 is then actuated to lock the lower and upper segments of the connector assembly 49. The guide ram mechanism 60 guides and centralizes the connector assembly 49 into place and an internal rack serves to rotate a lock sleeve of the lower segment 49A to lock the first and second connector assembly segments 49A, 49B.

The isolation ram mechanism 63 is actuated to seal around a portion of the connector assembly 49. During insertion of the tool string, this serves to isolate the inner chamber of the lubricator 54 from the wellhead pressure. At this point, the gate valves 58 are open and the pressure above the isolation ram mechanism 63 has been bled. As a result, with the wellhead pressure isolated from the lubricator 54, connection or disconnection of the next gun 8 to the string 6 in the lubricator 54 does not have to occur at high pressure. Instead, the lubricator 54 is maintained at atmospheric or low pressure to make manipulation of a tool section more precise. This allows a well operator to have as much control as possible to perform connection or disconnection operations.

As shown in FIG. 2, the gun 8 being deployed is run into the lubricator 54 with a running tool 47, which is connected by a connector assembly 49 to the gun 8 being deployed. Once connected, the gun 8 being deployed is now part of the gun string 6. The running tool 47 lowers the gun string 6 until the connector assembly 49 connecting the running tool 47 to the gun string 6 is engaged in the deployment stack 59, with the no-go mechanism 62 and isolation ram mechanism 63 being actuated to engage the connector assembly 49. At this point, it is desired to disconnect the running tool 47 from the string 6. This is accomplished by actuating the rack in the guide ram mechanism 60 to rotate the lock sleeve which unlocks the connector assembly upper segment 49B from the connector assembly lower segment 49A.

Without re-pressurizing the lubricator 54, the running tool together with its attached connector assembly upper segment 49B is then raised above the gate valves 58, which are then closed. The stripper 52 and injector head (not shown) are removed. Since gate valves 58 are closed, the lubricator 54 is at atmospheric pressure. The running tool 47 is then connected to the next gun 8 to be deployed. The lower end of the next gun 8 being deployed is attached to a connector assembly upper segment 49B. The running tool 47 and gun 8 being deployed are then inserted into the lubricator 54, and the stripper 52 and injector head are reconnected. The gate valves 58 are opened and the gun 8 and the running tool are lowered so that the connector assembly upper segment 49B attached to the gun stabs into the connector assembly lower segment 49A. The rack of the guide ram mechanism 60 is then used to rotate the lock sleeve of the connector assembly lower segment 49A to lock the connector assembly upper and lower segments.

At this point, pressure across the isolation ram mechanism 63 is equalized by opening external equalization ports. Once the pressure is equalized, the ram mechanisms 60, 62, and 63 are released allowing the running tool to lower the current gun string 6 until the upper and newly attached connector assembly 49 is adjacent the deployment stack 59. The process can then be repeated until the desired number of guns 8 are added to the gun string 6. Once the last perforating gun is added, coiled tubing is injected through the injector head and attached to the assembled gun string. The gun string 6 is now ready for full deployment.

During the connection operation discussed above, the sealing ram mechanism 63 provides the necessary isolation of wellhead pressure from the lubricator. However, during the retrieval and disconnection operation, the sealing ram mechanism 63 may not be enough to isolate the lubricator 54 from the wellhead pressure since a fluid communication path may have been opened up due to activation of the tool string. For example, if the tool string is a perforating gun string, a detonating cord and associated explosive components are run through an inner bore of the string. Before detonation, the inner bore of the perforating string is sealed so that, once the isolation ram mechanism 63 is sealed around the connector assembly 49, isolation of wellhead pressure from the lubricator 54 is achieved. However, after detonation, the detonating cord disintegrates and the components providing the seal within the gun string are destroyed. As a result, a portion of the inner bore of the perforating string is empty and provides a fluid flow path. In accordance with some embodiments, a barrier mechanism is provided to block the detonating cord path and thus provide full isolation between the wellhead pressure and the lubricator 54, thereby enabling the retrieval of a gun from the gun string in the lubricator 54 at atmospheric or low pressure.

To disconnect perforating guns 8 from the gun string 6 as the gun string is removed from the wellbore and well surface equipment 56, the uppermost connector assembly 49 of the gun string 6 is first secured by the ram no-go mechanism 62 of the deployment stack 59 and sealed by isolation ram mechanism 63. Once the connector assembly 49 is properly secured by the deployment stack 59 and the seal isolation ram mechanism 63 is sealingly engaged to the connector assembly 49, wellhead pressure may not pass above the isolation ram mechanism 63 along the exterior of the connector assembly 49. In addition, the barrier mechanism (in the connector assembly 49 or provided elsewhere along the string) prevents fluid communication of wellbore fluids through the detonating cord path. Thus, the isolation ram mechanism 63 and the barrier mechanism, in combination, serve to isolate the wellhead pressure from the area above the isolation ram mechanism 63, including the lubricator 54.

The barrier mechanisms used in some embodiments are able to provide the necessary blockage of wellbore pressure isolation without the use of primary explosives. Primary explosives are associated with safety problems. A few of the embodiments described here use explosives in the barrier mechanisms—however, the explosives are not primary explosives.

The pressure within the lubricator 54 and above the isolation ram mechanism 63 is then bled off. The rack of the guide ram isolation ram mechanism 63 is then rotated so as to unlock the lock sleeve of the connector assembly lower segment 49A, thus enabling retrieval of the connector assembly upper segment 49B along with the attached gun 8. Without re-pressurizing the lubricator 54, the gun string 8 is then raised. Since the lubricator 54 is at atmospheric or low pressure, the operator has the required control over the load applied to the connector to precisely perform the disengagement operation.

Once the gun 8 being removed is raised over the gate valves 58, the gate valves 58 are closed, and the stripper 52 and injector head (not shown) are then removed. The gun 8 is then disconnected from the running tool. Next, the running tool attached at its lower end to a connector assembly upper segment 49B is inserted within the lubricator 54, and the stripper 52 and the injector head are reconnected. The gate valves 58 are then reopened. The running tool and the connector assembly upper segment 49B are then lowered so that the upper segment 49B stabs back into the connector assembly lower segment 49A. The rack of the guide ram mechanism 60 is then used to rotate the lock sleeve to lock the connector assembly upper and lower segments. At this point, pressure across isolation ram mechanism 63 is equalized by opening external equalization ports. Once the pressure is equalized, ram mechanisms 60, 62, and 63 are disengaged to allow the running tool to raise the gun string 6 until the next connector assembly 49 is adjacent the deployment stack 59, at which point the process is repeated until the entire gun string 6 has been retrieved. Again, since the lubricator 54 is at atmospheric or low pressure, the operator has the required control over the load applied to the connector to precisely perform the disengagement operation.

Although the deployment and retrieval operations have been described using the connector assembly 49, it should be noted, however, that other types of mechanisms can be employed in other embodiments.

Figure 3:
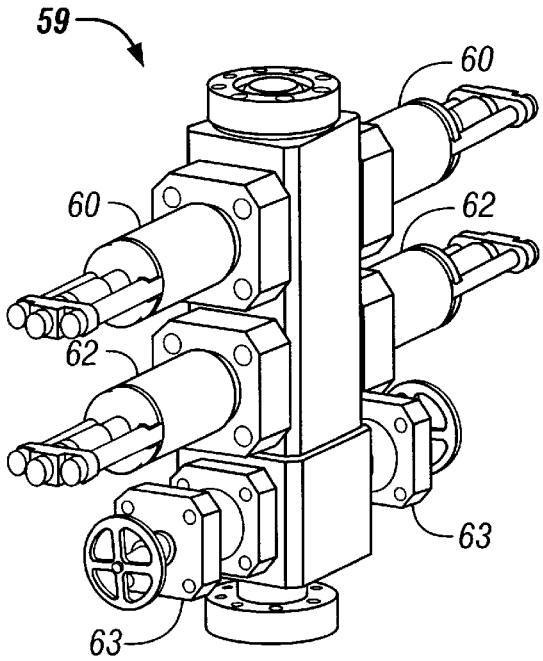
FIG. 3 is a perspective view of a deployment stack in the well surface equipment of FIG. 1.
Figure 4:
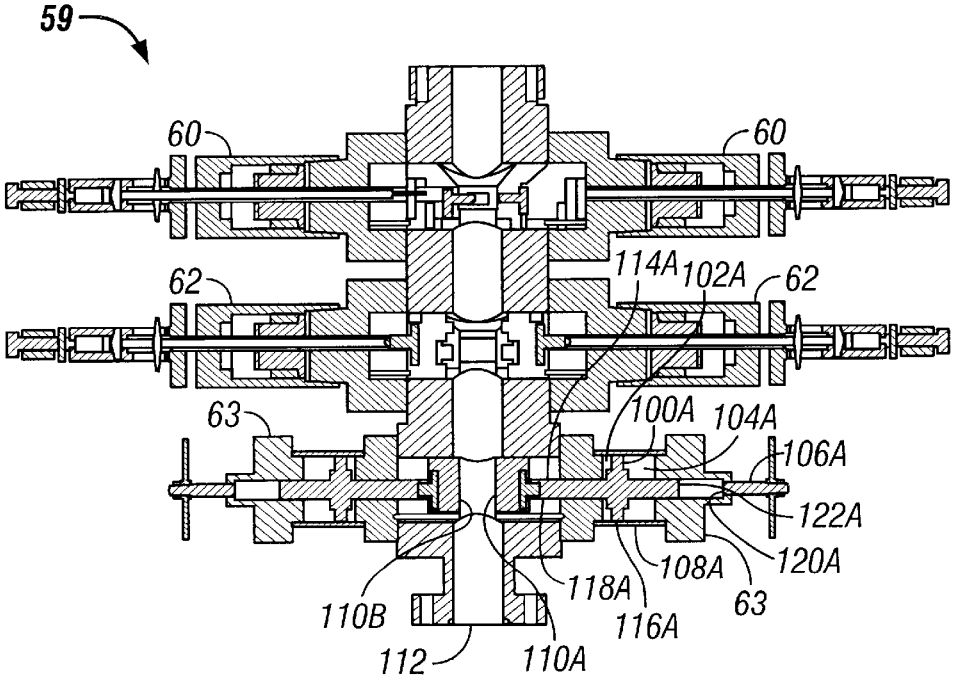
FIG. 4 is a longitudinal sectional view of the deployment stack of FIG. 3.

FIG. 3 is a perspective view of the deployment stack 59, and FIG. 4 is a longitudinal sectional view of the deployment stack 59. Each of the ram mechanisms 60, 62, and 63 includes a respective pressure-activated actuator to actuate respective rams.

The deployment stack 59 has a longitudinal bore 112 (FIG. 4) into which a connector assembly 49 is inserted. The isolation ram mechanism 63 has two actuators, with the actuators moving respective rams 110A and 110B inwardly into the longitudinal bore 112. The ram 110A is connected to an actuating rod 114A. Extending radially outwardly from the actuating rod 114A is a piston 100A. As shown in FIG. 4, the piston 100A is integrally formed with the actuating rod 114A. A seal 116A is provided around the outer circumference of the piston 100A, with the seal 116A engaging a housing section 108A of the isolation ram mechanism 63. The seal 116A isolates two chambers 102A and 104A. Control lines (not shown) communicate pressure to respective chambers 102A and 104A. Depending on the desired direction of movement of the piston 100A, a differential pressure is supplied between the chambers 102A and 104A. To move the ram 110A radially inwardly into the longitudinal bore 112, a higher pressure is provided in the chamber 104A than in the chamber 102A to move the piston 110A radially inwardly. On the other hand, to remove the ram 110A from the longitudinal bore 112 and back into a gap 118A, a higher pressure is provided in the chamber 102A than in the chamber 104A, which pushes the piston 100A in a radially outward direction In the illustrated embodiment, the isolation ram mechanism 63 is also provided with a mechanical lock 106A, which is rotatably actuated to engage an end portion 120A of the lock 106A against a first end 122A of the actuating rod 114A. Once the ram 110A has been actuated by pressure to move inwardly into the longitudinal bore 112, a user operates the mechanical lock 106A to engage the end 120A against the first end 122A of the actuating rod 114A to maintain a mechanical lock so that the ram 110A remains in its actuated position. Thus, in case the hydraulic system fails such that the differential pressure in chambers 104A and 102A is removed, the mechanical lock 106A maintains the ram 110A in position to maintain wellhead pressure isolation.

The other actuator for the ram 110B of the isolation ram mechanism 63 has identical elements as discussed above and all of the same components are labeled with the suffix "B" to indicate corresponding components. Thus, when actuated, both rams 110A and 110B protrude into the longitudinal bore 112 and into sealing engagement with each other. If a connector assembly 49 is positioned within the deployment stack 59, according to one embodiment, the rams 110A and 110B engage an outer surface of the connector assembly 49 to provide a sealing engagement such that pressure below the isolation ram mechanism 63 is not communicated to the space above the isolation ram mechanism 63. This effectively blocks pressure communication around the outside of the connector assembly 49 when it is positioned in the deployment stack 59 and the isolation ram mechanism 63 is actuated (with the rams 110A and 110B shown in the illustrated actuated position).

Figure 5:
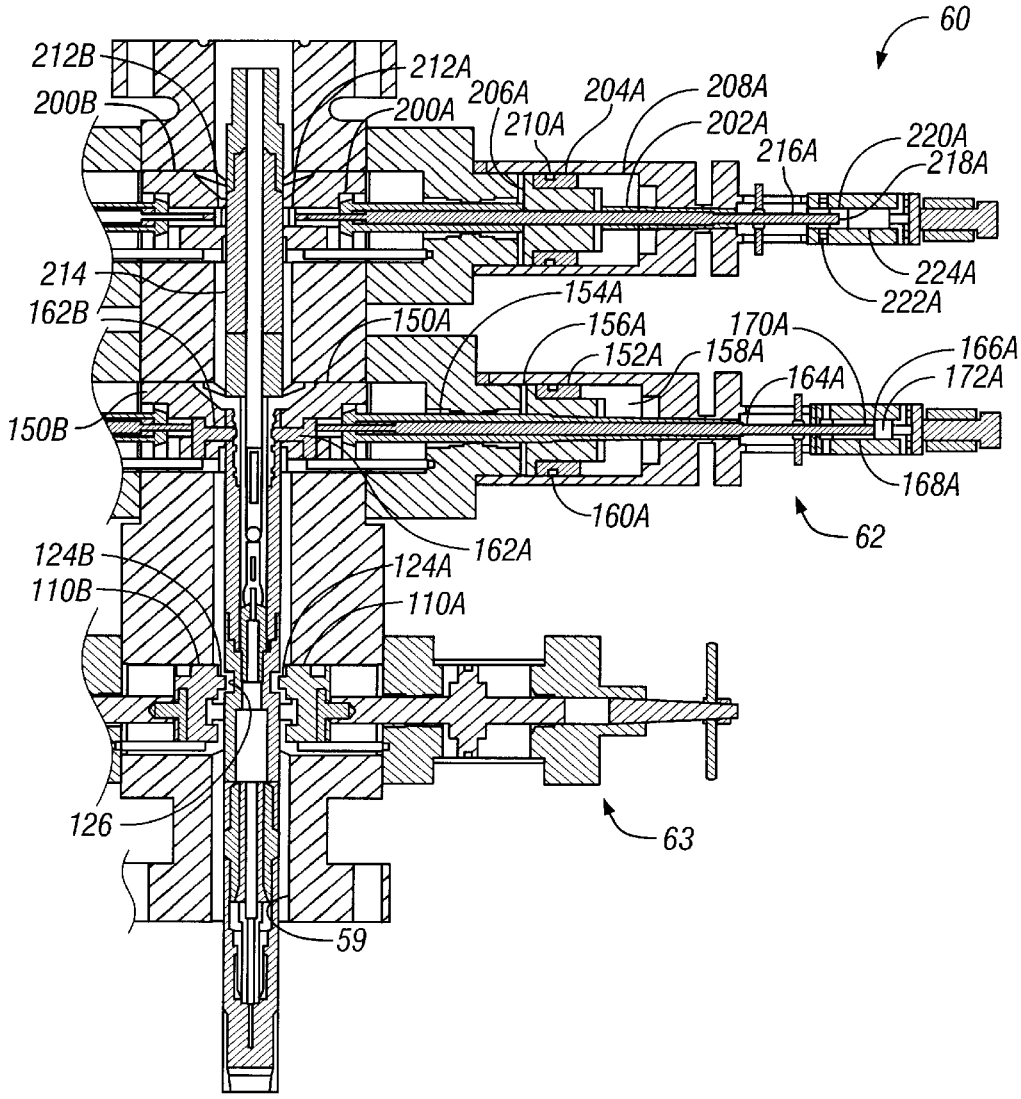
FIG. 5 is an enlarged longitudinal sectional view of a portion of the deployment stack of FIG. 3.

FIG. 5 shows a slightly more enlarged view of the combination of a portion of the deployment stack 59 and connector assembly 49 positioned in the longitudinal bore 112 of the deployment stack 59. The rams 110A and 110B of the isolation ram mechanism 63 shown in FIG. 5 is a slight variation of the rams 110A and 110B shown in FIG. 4. In FIG. 5, an inner surface of each ram 110A, 110B has a protrusion 124A, 124B (respectively) for engagement within a groove 126 of a housing of the connector assembly 49. The details of the connector assembly 49 are not discussed with respect to FIG. 5, but will be discussed in connection with FIGS. 10A–10B, 11A–11B, and 12 (discussed further below).

The groove 126 in the housing of the connector assembly 49 provides a load shoulder to prevent movement of the connector assembly 49 once the rams 110A and 110B are engaged in the groove 126. Note that once the isolation seal mechanism 63 is engaged, a large differential pressure may exist between the space below the isolation seal mechanism 63 (at wellhead pressure) and the space above the isolation ram mechanism 63 (at atmospheric or other low pressure). The groove 126, when engaged by the protrusions 124A and 124B of the rams 110A and 110B, prevent upward movement of the connector assembly 49 in response to the large differential pressure.

The no-go ram mechanism 62 also has two actuators for actuating no-go rams 150A and 150B, respectively. The ram 150A is connected to an actuating mandrel 154A. A piston 152A is connected to the outer surface of the actuating mandrel 154A. As shown in FIG. 5, the piston 152A has two parts. In a different embodiment, the piston 152A can be an integrated single cylinder. A seal 160A is provided around the outer circumference of the piston 152A. The seal 160A isolates two chambers 156A and 158A. Control conduits (not shown) communicate pressure to the chambers 156A and 158A to control movement of the piston 152A either in the radially inward direction to actuate the ram 150A against the connector assembly 49, or to move the piston 152A in the radially outwardly direction to disengage the no-go ram 150A from the connector assembly 49.

The no-go ram 150B is actuated by the same type of actuator as discussed above in connection with the no-go 150A.

In addition to the no-go rams 150A and 150B, the no-go ram mechanism 62 also has lock rams 162A and 162B. The lock rams 162A and 162B are designed to lock the outer surface of the connector assembly 49 to prevent movement of the connector assembly 49 once the no-go ram mechanism 62 is fully engaged against the connector assembly 49. The lock ram 162A is connected to an actuating rod 164A, which runs through an inner bore of the actuating mandrel 154A. The actuating rod 164A is coupled to a piston 166A. A seal 168A is provided around the outer circumference of the piston 166A. The seal 168A isolates chamber 170A from chamber 172A. Control conduits (not shown) communicate pressure to chambers 170A and 172A, respectively, to control movement of the piston 166A (and thus the corresponding movement of the actuating rod of 164A) in the radially inwardly direction (to actuate the lock ram 162A against the connector assembly 49) or the radially outward direction (to disengage the lock ram 162A from the connector assembly 49). The lock ram 162B is actuated by the same type of actuating mechanism as discussed above for the lock ram 162A.

The guide ram mechanism 60 has guide rams 200A and 200B that are actuated by respective actuators. The guide ram 200A is coupled to an actuating mandrel 202A. A piston 204A is attached to an outer surface of the actuating mandrel 202A. A seal 210A is provided around the outer circumference of the piston 204A. The seal 210A isolates a chamber 206A from a chamber 208A. Pressure communicated to the chambers 206A and 208A control movement of the piston 210A and corresponding movement of the actuating mandrel 202A to actuate or disengage the guide ram 200A.

The guide ram 200B is actuated by the same actuating mechanism as for the guide ram 200A. In addition, the guide ram mechanism 60 includes racks 212A and 212B for rotating a lock sleeve 214 of the connector assembly 49. The rack 212A is connected to an actuating rod 216A that runs through an inner bore of the actuating mandrel 202A. The outer end of the actuating rod 216A is connected to a piston 218A, which has a seal 220A around the outer circumference of the piston 220A. The seal 220A isolates a chamber 222A from a chamber 224A. Differential pressure in the chambers 222A and 224A control movement of the piston 218A and thus corresponding movement of the actuating rod 216A. Actuating the rack 212A causes a predetermined amount of rotational movement of the lock sleeve 214 of the connector assembly 49.

The rack 212B is actuated by the same mechanism as for the rack 212A.

Figure 6:
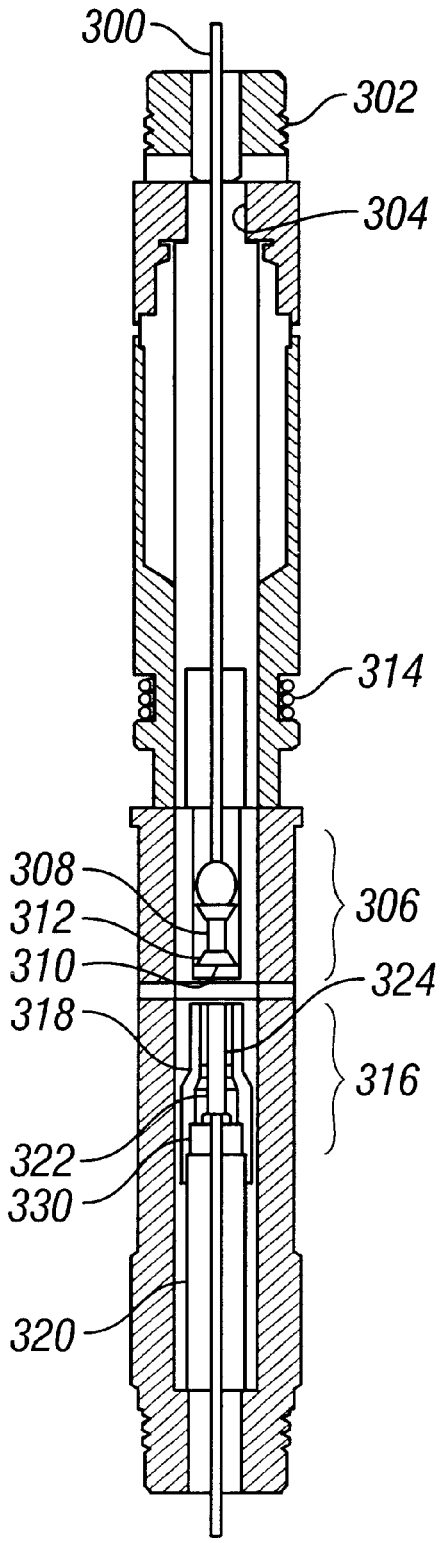
FIG. 6 is a longitudinal sectional view of a connector assembly for connecting tool sections, with the connector assembly including a barrier mechanism in accordance with an embodiment.

If the tool string being assembled at the wellhead is a perforating tool string, then the connector assembly 49 has to provide a ballistic connection between successive gun sections. Thus, the connector assembly 49 both physically and ballistically connects a gun section above the connector assembly 49 to a gun section below the connector assembly 49. As shown in FIG. 6, the connector assembly 49 has a detonating cord 300 that extends from a gun section that is connected to an upper gun adapter 302 of the connector assembly 49. The detonating cord 300 extends through a bore 304 of the connector assembly 49. The detonating cord 300 extends to a trigger explosive section 306 contained inside the housing of the connector assembly 49. The trigger explosive section 306 includes an explosive 308 to which the detonating cord 300 is contacted. Also, a trigger charge 310 is contacted to the explosive 308. The trigger explosive section 306 is contained within a trigger charge cover 312, which is sealably connected to a sleeve 314 that defines the path 304 through which the detonating cord 300 extends within the connector assembly 49. The sleeve 314 is in turn sealably engaged to an inner surface of an outer housing of the connector assembly 49. Therefore, fluid isolation is provided to prevent communication of fluid through the inner bore of the connector assembly 49.

The trigger explosive section 306 is positioned adjacent another explosive section 316 (the "booster explosive section"). The booster explosive section 316 is initiated in response to detonation of the trigger charge 310 in the trigger explosive section 306. The booster explosive section 316 also includes a booster charge cover 318 that is sealably engaged to a sleeve 320 at the lower portion of the connector assembly 49. Within the booster charge cover 318 is a receptor booster explosive charge 322, which is in turn ballistically connected to an explosive 324. The explosive 324 is ballistically connected to a through-bulkhead-initiator (TBI) assembly 330, which has a bulkhead or membrane though which an explosive force is able to be communicated without the bulkhead or membrane puncturing, shattering or having an opening formed therethrough.

The TBI assembly 330 is one embodiment of the barrier mechanism discussed above to maintain wellhead pressure isolation even after detonation. The TBI assembly 330 is ballistically connected to the next portion of the detonating cord 330, which extends through an inner bore of the sleeve 320. Note that the inner path of the connector assembly 49 is sealed as long as the detonating cord 300 and the explosive sections 306 and 316 are not initiated. Upon initiating of the detonating cord 300 and the explosive sections of 306 and 316, the trigger charge cover 312 and booster charge cover 318 are destroyed, which opens up fluid paths along the longitudinal bore of the connector assembly 49. Without the TBI assembly 330, this would allow wellhead pressure that is below the connector assembly 49 to be communicated through the connector assembly 49 to the space above the connector assembly 49. Note that the space above the connector assembly 49 is desired to be at atmospheric pressure or some other low pressure, so that the open fluid path through the connector assembly 49 would cause wellbore pressure to quickly discharge through the open fluid path of the connector assembly 49.

Figure 7:
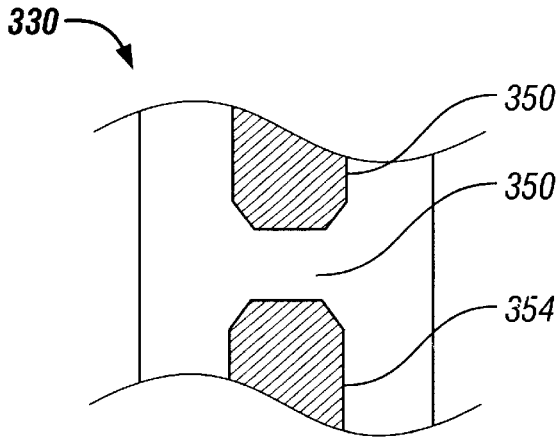
FIG. 7 illustrates the barrier mechanism of FIG. 6.

The TBI assembly 330 is shown in greater detail in FIG. 7. With the TBI assembly 330, detonation is transmitted through a pressure isolation membrane or bulkhead 350, which can be a membrane formed of a metal. Effectively, the TBI assembly 330 includes an explosive transfer device that transfers detonation or ignition of an explosive portion 352 through the solid bulkhead 350 to the next explosive portion 354, with the bulkhead 350 providing a pressure barrier before and after initiation.

A benefit of using the TBI assembly 330 is that detonation transfer can be accomplished without using a secondary mechanical device such as a sealed detonator and firing pin. A further benefit of using the TBI assembly 330 is that its bulkhead does not puncture in response to detonation of explosive portions 352 and 354. As a result, pressure integrity is maintained so that the wellbore pressure below the connector assembly 49 is not communicated through an inner path of the connector assembly 49. Therefore, the space above the connector assembly 49, such as the space inside the lubricator 54, is maintained at atmospheric pressure (or at some other target low pressure) to enhance convenience in disconnecting sections of the perforating gun string after tool string activation and upon retrieval from the wellbore.

Although the TBI assembly 330 is shown positioned below the booster explosive section 316, that is but just one example implementation. In other implementations, the TBI assembly 330 can be moved anywhere along the ballistic path within the connector assembly 49. The key is that the TBI assembly 330 is able to transfer ballistic initiation from one explosive component to the next explosive component without resulting in the creation of an open path through the TBI assembly 330.

Figure 8:
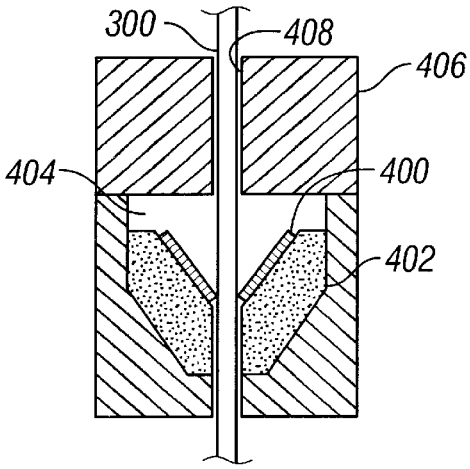
FIGS. 8–23 illustrate barrier mechanisms in accordance with other embodiments.
Figure 9:
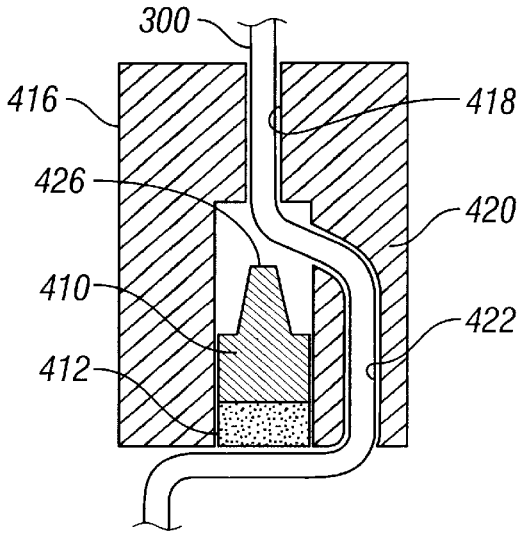

The TBI assembly 330 is one embodiment of the barrier mechanism. FIGS. 8 and 9 illustrate other embodiments of the barrier mechanism that can be provided within the connector assembly 49 (or elsewhere along the tool string) to block fluid communication through the inner path of the connector assembly after detonation of explosive components in the connector assembly 49.

FIG. 8 shows a barrier mechanism having a cavity 404 formed in a housing 406 (which can be a housing section of the connector assembly 49 or a housing section of another portion of the tool string). The detonating cord 300 extends through a bore 408 of the housing 406 and through a cavity 404. An explosive charge 402 is disposed within the cavity 404. The explosive charge 402 is shaped into a generally conical shape. A liner 400 lines an inner surface of the explosive charge 402. The liner 400 is implemented as either two separate sections or as a conical liner with an opening at its apex to allow the detonating cord 300 to pass through.

The diameter of the bore 408 is designed to be as small as possible so that the bore 408 is easy to plug.

In operation, as a detonation wave travels along the detonating cord 300, the detonating cord 300 disintegrates, leaving a detonating cord path open. By the time the detonation wave reaches the charge 402, the detonating cord path "upstream" of the charge 102 will be open. When the detonation wave reaches the charge 102, the charge is initiated, thereby collapsing the liner 400 and propelling a perforating jet "upstream" into the bore 408 of the housing 406. A plug is generated at the tail end of the perforating jet, with the plug being propelled at a high velocity and becoming wedged within the bore 408 to thereafter act as a seal to block fluid communication. Once the housing bore 408 is plugged, wellbore pressure isolation is provided and the inner path shown in FIG. 8 is blocked.

In the design of FIG. 9, the detonating cord 300 is also run through a bore 418 of a housing 416. A side bore 422 extends through a housing section 420 of the connector assembly 49. The detonating cord 300 is routed through the side bore 422. A section of the detonating cord 300 is positioned adjacent a lower end of an explosive charge 412. A dart or plug 410 is place above the charge 412. The dart or plug 410 has a pointed tip 426 that is shaped to enter the bore 418. The dart or plug 410 is configured to lodge within the bore 418.

When the detonating cord 300 is initiated, a detonation wave travels along the detonating cord, disintegrating the cord 300 along the way. When the detonation wave reaches the section of the detonating cord 300 adjacent the explosive charge 412, the charge 412 is initiated to propel the plug 410 upwardly. The plug 410 is propelled with sufficient force such that the pointed portion of the dart 426 is lodged within the bore 418 of the housing 416. This effectively blocks the bore 418 after detonation, which provides the fluid pressure barrier.

It should be noted that the assembly shown in FIG. 8 or 9 may be disposed within the detonating cord path of any section of the gun string, even within the detonating cord path of a perforating gun, or within the detonating cord path of other tools not associated with a gun string. Moreover, the assembly shown in FIG. 8 or 9 may be located at various points along a gun string, thereby facilitating the disconnection of sections of the gun string while the wellbore is under pressure.

Figure 10A:
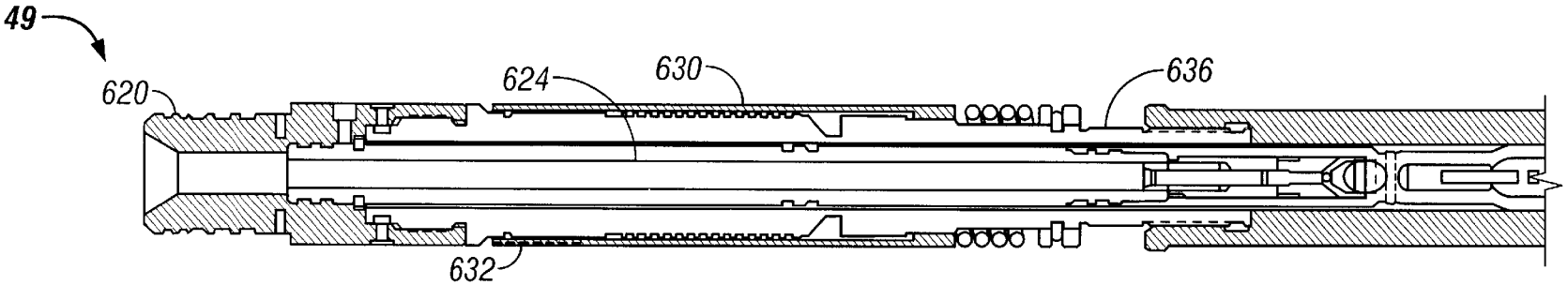
Figure 10B:
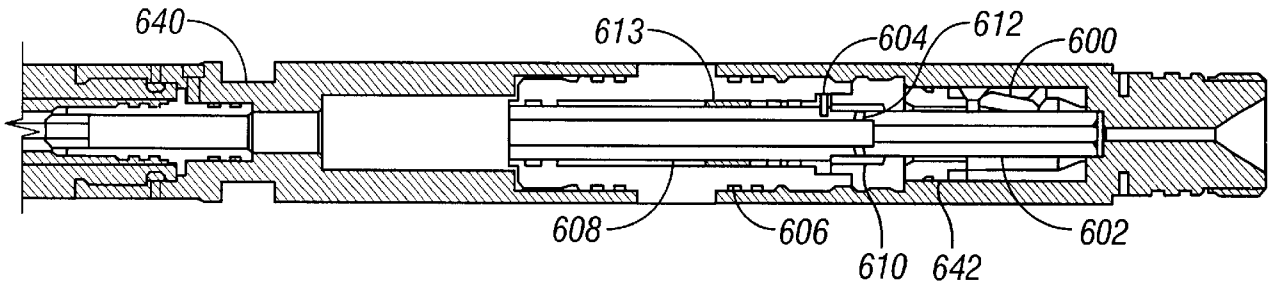
Figure 11A:
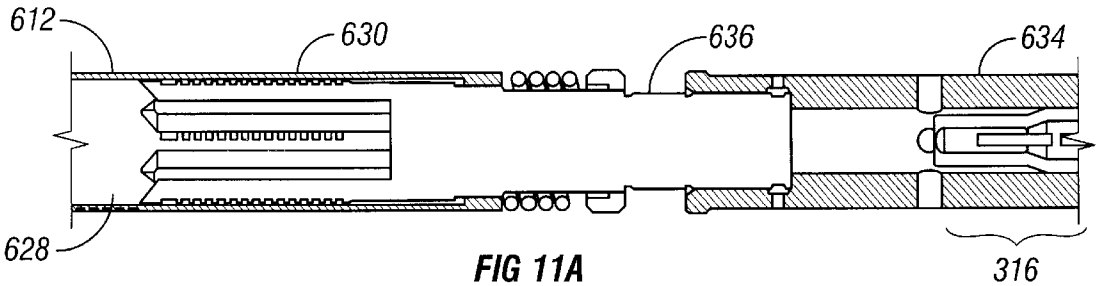
Figure 11B:
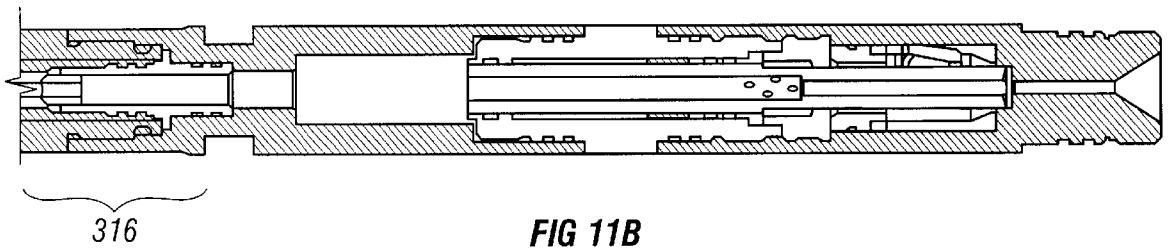

FIGS. 10A–10B illustrate a different embodiment of a barrier mechanism (implemented in the barrier mechanism 49) to block the detonating cord path after initiation of the detonating cord (which is not shown but which runs through the inner bore of the connector assembly 49). Generally, the embodiment of FIGS. 10A–10B includes a moving blocking component that blocks the detonating cord path after detonation. In the embodiment shown in FIGS. 10A–10B, the moving blocking component includes a flapper valve 600. In other embodiments, as described in connection with the other Figures below, other embodiments use other types of moving blocking components. In some of these designs, the blocking occurs immediately after the guns are fired. In others of these designs, the blocking occurs only after a differential pressure is created across the moving blocking component.

In order to prevent the premature movement of the moving blocking component (e.g., the flapper valve 600), the moving blocking component can be locked in place by a locking component (e.g., a mandrel 602 and associated elements) that is unlocked in response to initiation of the detonating cord. Any of the designs that include the blocking and locking components and may be implemented anywhere along the length of the gun string, such as within a perforating gun or the connector assembly or such as within its own separate housing attached to the gun string.

Figure 12:
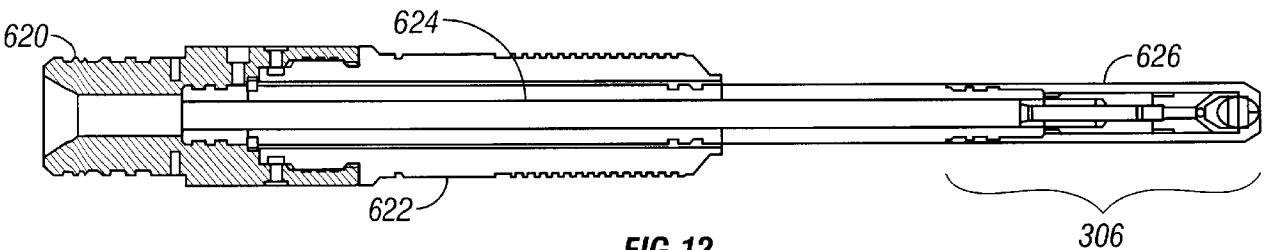

In addition to FIGS. 10A–10B, FIGS. 11A–11B illustrate the lower segment 49B of the connector assembly 49, and FIG. 12 illustrates the upper segment 49B of the connector assembly 49. FIGS. 10A–10B illustrate the connector assembly 49 with the upper and lower segments 49A and 49B engaged. Note that in the lower segment 49A, only the booster explosive section 316 is present. The trigger explosive section 306 is located in the upper segment 49B of the connector assembly 49.

In the embodiment of FIGS. 10A–10B, 11A–11B, and 12, the flapper valve 600 is located at a lower portion of a connector assembly 49. The flapper valve 600 is kept in the open position (shown in FIGS. 10A–10B and 11A–11B) by the mandrel 602. The mandrel 602 is maintained in the position shown in FIGS. 10A–10B and 11A–11B by a shear mechanism (such as a shear screw or shear pin) 604. The shear mechanism 604 is designed to withstand a certain differential pressure across seals 606 mounted on the outer surface of the mandrel 602 and engaged to an inner wall of a housing section. An atmospheric pressure chamber 608 is located on one side of the seals 606, and another chamber 610 is located on the other side of the seals 606. Radial ports 612 communicate fluid from the inner bore of the connector assembly 49 to the chamber 610.

The chambers 608 and 610 define a differential pressure to cause movement of the mandrel 602. Before initiation of the detonating cord, both chambers 608 and 610 are at atmospheric pressure so that no movement of the mandrel 602 occurs. The radial ports 612 communicate wellbore pressure through the chamber 610 once the detonating cord has been initiated and a fluid flow path is provided inside the connector assembly 49.

In the embodiment of FIGS. 10A–10B and 11A–11B, a shock absorber 613 is provided in the atmospheric chamber 608 so that upward movement of the mandrel 602 and the resultant impact of the mandrel 602 to the housing of the connector assembly 49 does not cause damage to the connector assembly 49.

As shown in FIG. 12, the connector assembly upper segment 49B has a gun adapter 620 for connection to a gun section above the connector assembly 49. Connected below the gun adapter 620 is a housing section 622. Also, a sleeve 624 is connected within the gun adapter 620 and housing section 622. The lower end of the sleeve 624 is sealably connected to the trigger charge cover 626 that is similar in design to the trigger charge cover 312 shown in FIG. 6. The trigger charge cover 626 is part of the trigger explosive section 306.

The housing section 622 behaves as a stinger for insertion into a chamber 628 of the connector assembly lower segment 49A. The chamber 628 is housed within a lock sleeve 630 (similar to the lock sleeve 214 of FIG. 5). At the outer surface of an upper portion of the lock sleeve 630, a rack profile 632 is provided to engage the rack of the guide ram mechanism 60 (shown in FIGS. 1 and 5). The rack profile 632 is engaged by the racks 212A and 212B of the guide ram mechanism 60 to rotate the lock sleeve 630 upon actuation of the racks 212A and 212B. Rotation of the lock sleeve 630 upon actuation of the racks 212A and 212B causes the upper segment 49B of the connector assembly 49 to be locked against the lower segment 49A of the connector assembly 49. On the other hand, upon disengagement of the racks 212A and 212B in the guide ram mechanism 60, the lock sleeve 630 is rotated in the opposite rotational direction to unlock the upper segment 49B and lower segment 49A. The trigger charge cover 626 is lowered into proximity with a booster charge cover 634 that contains the booster explosive section 316. The booster explosive section 316 is initiated in response to initiation of the trigger explosive section 306.

A lock profile 636 is also provided in the outer surface of the connector assembly 49, as shown in FIGS. 10A–10B and 11A–11B. The lock profile 636 is designed to receive the lock rams 162A and 162B of the no-go ramp mechanism 62.

As further shown in FIGS. 10A–10B and 11A–11B, another profile 640 is provided in the outer surface of the connector assembly 49 further down. This profile 640 (similar to groove 126 of FIG. 5) is designed to receive isolation rams 110A and 110B of the isolation ram mechanism 63.

In operation, when the detonating cord is initiated, the trigger explosive section 306 and booster explosive section 316 are also initiated to destroy the covers 626 and 634. As a result, a detonating cord path is opened up. Also, activation of the guns in the gun string causes openings to be blown in the gun carrier to allow well fluids to enter the gun string. This communicates wellbore pressure to the chamber 610 (FIG. 10B) on one side of the seals 606 of the mandrel 602. This causes a differential pressure to be created between chambers 610 and 608. If the differential pressure is high enough, the shear mechanism 604 is broken so that the mandrel 602 is pushed upwardly by the differential pressure. This causes the lower end of the mandrel 602 to move away from the flapper valve 600, so that the flapper valve 600 engages a flapper valve seat 642 to provide a fluid seal. Once the flapper valve 600 is closed, communication through the inner bore of the connector assembly 49 is blocked so that wellbore pressure isolation is maintained by the connector assembly 49.

Figure 13:
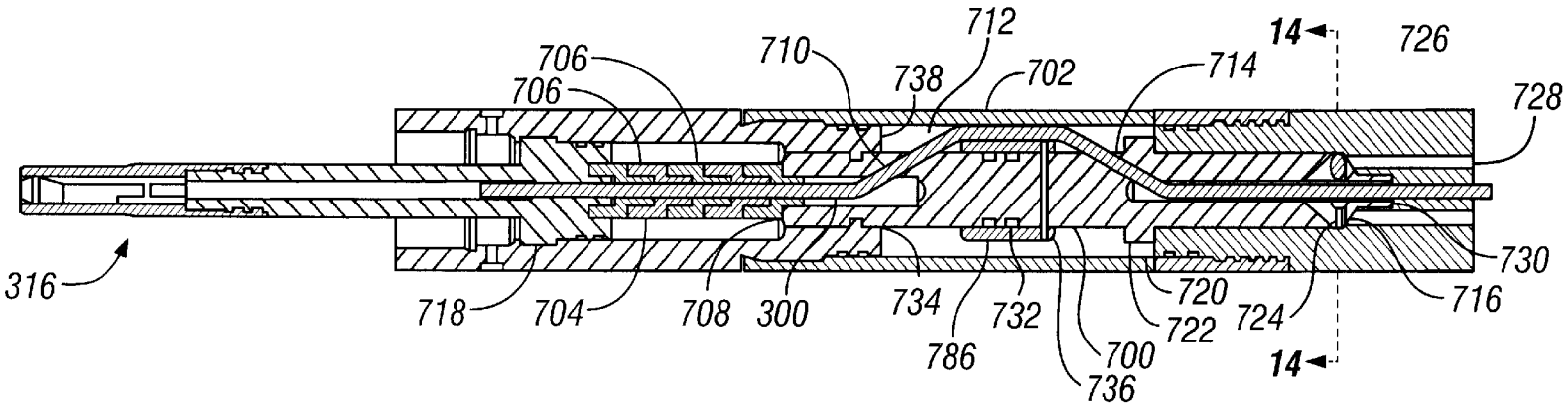
Figure 14:
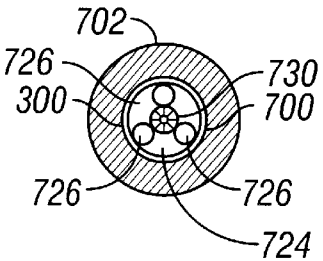

FIGS. 13 and 14 show another embodiment of a barrier mechanism. In this other embodiment, the moving blocking component includes a sliding mandrel 700 housed in a sliding mandrel housing 702. In this design the locking component includes a break plug 704, which can be constructed from a plurality of interconnected cup-shaped frangible elements 706. The detonating cord 300 and detonating cord path extend from the booster explosive section 316 through the break plug 704, and through one end 708 of the sliding mandrel 700. The detonating cord further extends out of the sliding mandrel 700 through a side opening 710, along a space 712 defined between the sliding mandrel 700 and the housing 702, back into the sliding mandrel 700 through another side opening 714, within and out of the sliding mandrel 700 through the other end 716 of the sliding mandrel 700, and down through the remainder of the gun string.

Prior to detonation of the detonating cord and firing of the perforating guns, axial movement of the sliding mandrel 700 is restricted since the sliding mandrel 700 is lodged between the break plug 704, which is wedged into an adapter 718 fixedly engaged to the housing 702, and a housing shoulder 720 (which abuts a sliding mandrel shoulder 722). Sliding mandrel end 716 includes a recess 724 that may be conically shaped. A plurality of balls 726 (shown in the cross-sectional view of FIG. 14) are housed in the recess 724 and are maintained in the recess 724 by a lower element 728 which abuts the sliding mandrel 700 at the sliding mandrel end 716. A shunt 730 houses detonating cord 300 along recess 724 from sliding mandrel 700 to the lower element 728. The balls 726 are located exterior to shunt 730. The shunt 730, like the break plug 704, is formed of a frangible material so that it breaks apart in response to initiation of the detonating cord. The barrier mechanism discussed above is placed below the booster explosive section 316 in the connector assembly 49. However, other placements of the barrier mechanism are also possible.

As a detonation wave propagates along the detonating cord, several events occur. First, the detonation wave disintegrates the break plug 704 as the detonation wave passes through the break plug 704. In addition, the detonation wave disintegrates the shunt 730 as it passes through the shunt 730.

Once the detonating cord disintegrates, wellbore fluids that are under pressure flow into the detonating cord path through the lower element 728. Once a pressure differential is established across sliding mandrel 700 (such as when pressure is bled off above the housing 702), the pressure differential pushes the balls 726 toward the detonating cord path within the sliding mandrel 700. Pressure above the housing 702 may be bled off, for instance, when sections of the gun string are being retrieved. Balls 726 provide enough of an impedance through the detonating cord path so as to create a greater pressure differential across the balls 726. Since sliding mandrel 700 is no longer restricted by the break plug 704 (which has disintegrated), the pressure acting against the balls 726 and sliding mandrel 700 acts to slide the sliding mandrel 700 in the upward direction. Eventually, sliding mandrel 700 moves enough so that seals 732, which are located about the exterior of the sliding mandrel 700 and between the side openings 710 and 714, sealingly engage a smaller diameter section 734 of housing 702. The sealing engagement of seals 732 and housing section 734 seals the flowpath between side openings 710 and 714. Thus, this sealing engagement prevents fluid communication of the wellbore fluids through housing 702 and detonating cord path.

A protective sleeve 736 may be disposed around the seals 732, with the detonating cord located exterior to the protective sleeve 736. The protective sleeve 736 prevents damage to the seals 732 that may be caused by the detonation of the detonating cord. As sliding mandrel 700 slides based on the pressure acting against balls 726, protective sleeve 736 will come to abut housing section shoulder 738. The abutment stops further movement of protective sleeve 736 and allows continued movement of sliding mandrel 700, which uncovers seals 732.

Figure 15:
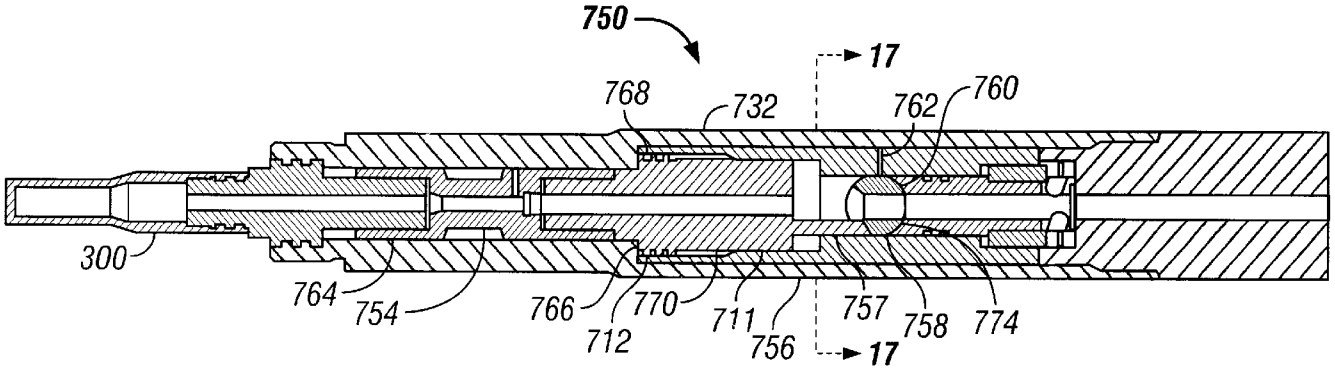
Figure 16:
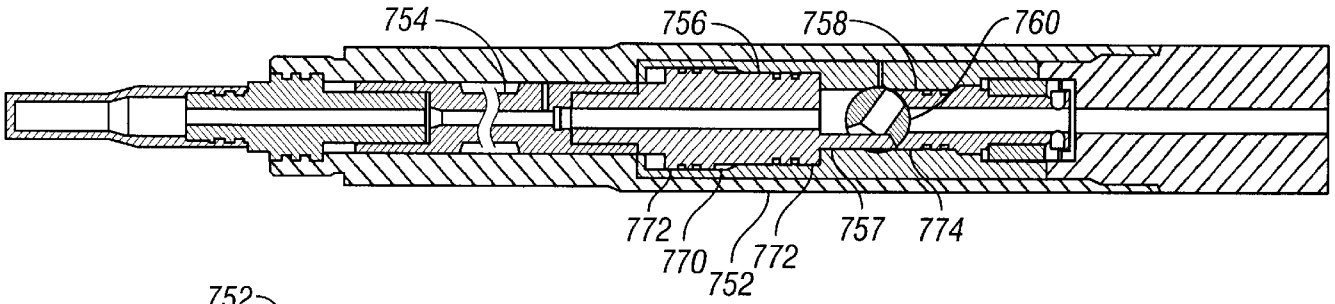
Figure 17:
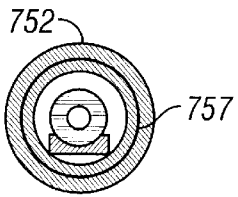

In an alternative embodiment, shown in FIGS. 15–17, the moving blocking component includes a barrel valve assembly 750 housed in barrel valve housing 752. In this implementation, the locking component includes a break plug 754 (and a shear pin 762). Barrel valve assembly 750 includes a mandrel 756 that selectively closes a barrel valve 758 upon the sliding movement of the mandrel 756. Mandrel 756 includes an activator 757, such as a finger (cross-sectional view shown in FIG. 17), that is operatively connected to barrel valve 758 so as to rotate barrel valve 758 when mandrel 756 slides. Barrel valve 758, which is initially secured in an open position by shear pin 762, selectively rotates about a valve seat 760. FIG. 15 shows the open position, and FIG. 16 shows the closed position. The sliding movement of the mandrel 756 is prevented until the break plug 754 is ruptured by the detonation of the detonating cord. The detonating cord and detonating cord path extend through the housing 752, the break plug 754, the mandrel 756, the barrel valve 758, and the valve seat 760. In the open position, the detonating cord path of the barrel valve 758 is aligned with the detonating cord path of the valve seat 760.

Before the guns are fired and the detonating cord disintegrates, axial movement of the mandrel 756 is restricted by the shear pin 762, which prevents premature rotation of the barrel valve 758, and the abutment of a mandrel shoulder 766 with a housing shoulder 768. Furthermore, break plug 754 is wedged between the mandrel 756 and an adapter 764.

As the detonation wave propagates along the detonating cord, the detonation wave disintegrates the break plug 754 (which is made of a frangible material) as the detonation wave passes through the break plug 754. Once the detonating cord disintegrates, wellbore fluids that are under pressure flow into the detonating cord path through the valve seat 760, the barrel valve 758, the mandrel 756, and the remainder of the break plug 754. Wellbore fluids will flow between the adapter 764/mandrel 756 and the housing 752 and will act against the mandrel shoulder 766 and an atmospheric chamber 770 formed by two sets of seals 772. If the differential pressure is high enough, the differential pressure causes the mandrel 756 to slide in the downward direction, forcing the barrel valve 758 to rotate and shearing the shear pin 762. Eventually, the mandrel 756 slides enough to rotate barrel valve 758 to the closed position.

In the closed position, the bore of the barrel valve 758 is not aligned with the detonating cord path of the valve seat 760. In addition, in the closed position, the barrel valve 758 sealingly engages seals 774 located on the valve seat 760. Thus, this sealing engagement and the nonalignment of flow paths prevent fluid communication of the wellbore fluids through housing 752 and detonating cord path.

Figure 18:
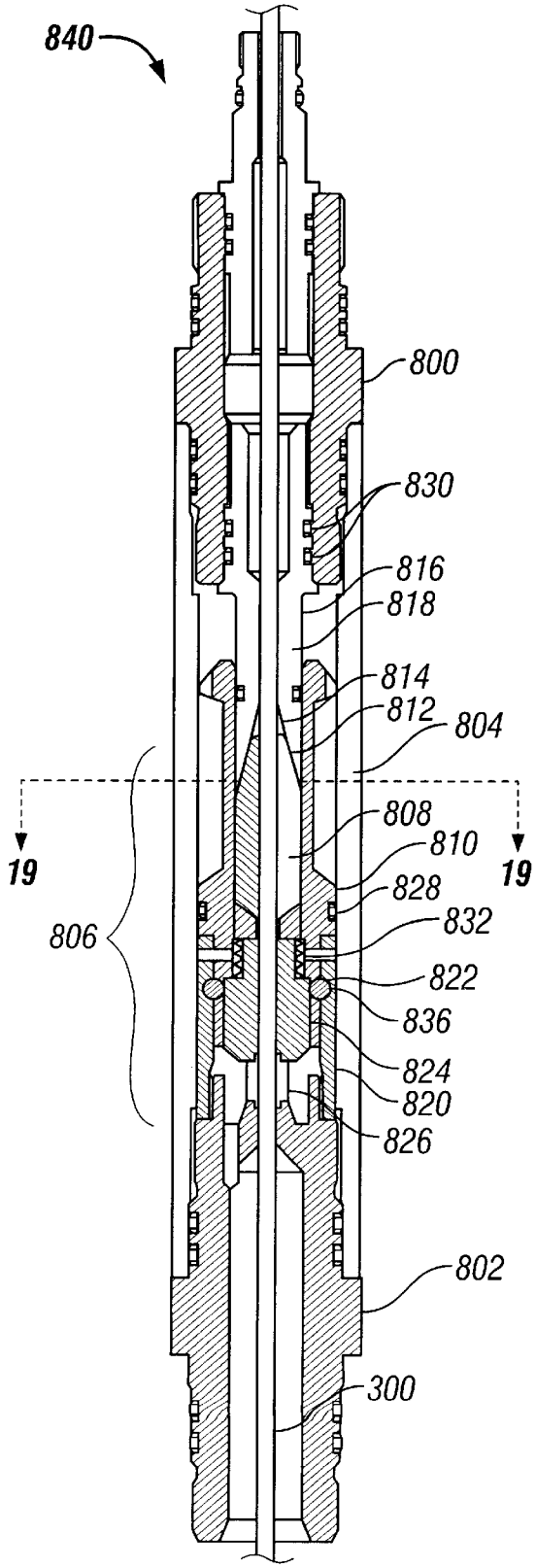
Figure 19:
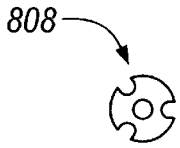

Yet another embodiment of a barrier mechanism 840 for use in a connector assembly (or for use in any other part of a perforating string) is illustrated in FIGS. 18–19. In the embodiment of FIG. 18, an upper adapter 800 is designed to connect to a connector assembly 49. Thus, the assembly shown in FIG. 18 is separate from the connector assembly 49. However, in other embodiments, the assembly of FIG. 18 can be provided as part of the connector assembly 49, or even as part of a gun section.

The lower end of the barrier mechanism 840 shown in FIG. 18 includes an adapter 802 for connection to a gun section. The adapters 800 and 802 are connected to a housing 804, which contains a valve assembly 806. The valve assembly 806 is designed to close in response to activation of a detonating cord 300 that extends through the barrier mechanism 840. The valve assembly 806 includes a plug 808 and a piston 810. One or more slanted surfaces 812 of the plug 808 are engaged to a corresponding slanted surface 814 of a seat 816 that is arranged inside the housing 804. The piston 810 encloses the plug 808 and defines an atmospheric chamber 818 with the housing 804 and the upper adapter 800. In case of a seal failure in the gun string below, the piston 810 is attached to the lower adapter 802 by a ball release mechanism. This safety feature is used to prevent detonation of the detonating cord 300 if the plug 808 closes against the detonating cord 300 when a differential pressure inadvertently occurs across the piston 810 before the guns are fired.

A retainer sleeve 820 screws onto the lower adapter 802. A number of steel balls 822 lock the piston 810 to the retainer sleeve 820. A ball retainer 824 keeps the balls 822 in place. A break stud 826 (formed of a frangible material) holds the ball retainer 824 until detonation of the detonating cord 300 shatters the break stud 826. The detonating cord 300 passes all the way through the barrier mechanism 840, including through a longitudinal bore provided by the valve assembly 806.

In one embodiment, the plug 808 includes a number of fingers (shown as three fingers in the top view of FIG. 19). However, the number of fingers is provided by way of example only, as other embodiments can have other numbers of fingers. The fingers of the plug 812 are pulled open to enable the detonating cord 300 to pass through the plug 808.

A seal 828 is provided around an outer circumference of the piston 810 to maintain the pressure within atmospheric chamber 818. At the upper end of the atmospheric chamber 818, seals 830 are provided around the seat 816 to engage an inner wall of the adapter 800.

In the position shown in FIG. 18 (before detonation of the detonating cord 300), a spring 832 is in a compressed state. This position is maintained by the ball release mechanism. Upon detonation of the detonating cord 300, the break stud 826 is shattered to remove the movement impeding barrier engaged against a ball retainer 824. This allows the spring 832 to push the ball retainer 824 downwardly, so that a portion of the ball retainer 824 having a reduced diameter is positioned adjacent the balls 822. This allows the balls 822 to fall out of grooves in the retainer sleeve 820. As a result, the piston 810 is no longer retained in position and is now allowed to move.

The wellbore pressure and the detonation shock wave cause a differential pressure to build up across the piston 810 with reference to the atmospheric chamber 818. The force created by the differential pressure pushes the piston 810 toward the seat 816. The piston 810 presses the plug 808 into the seat 816. The three fingers of the plug 808 are shaped in such a way that the entire space inside the seat 816 is filled with material without a gap when the fingers of the plug 808 are compressed. The finger tips of the plug 808 are forced into the bore of the seat 816 and forms a solid plug.

Figure 20:
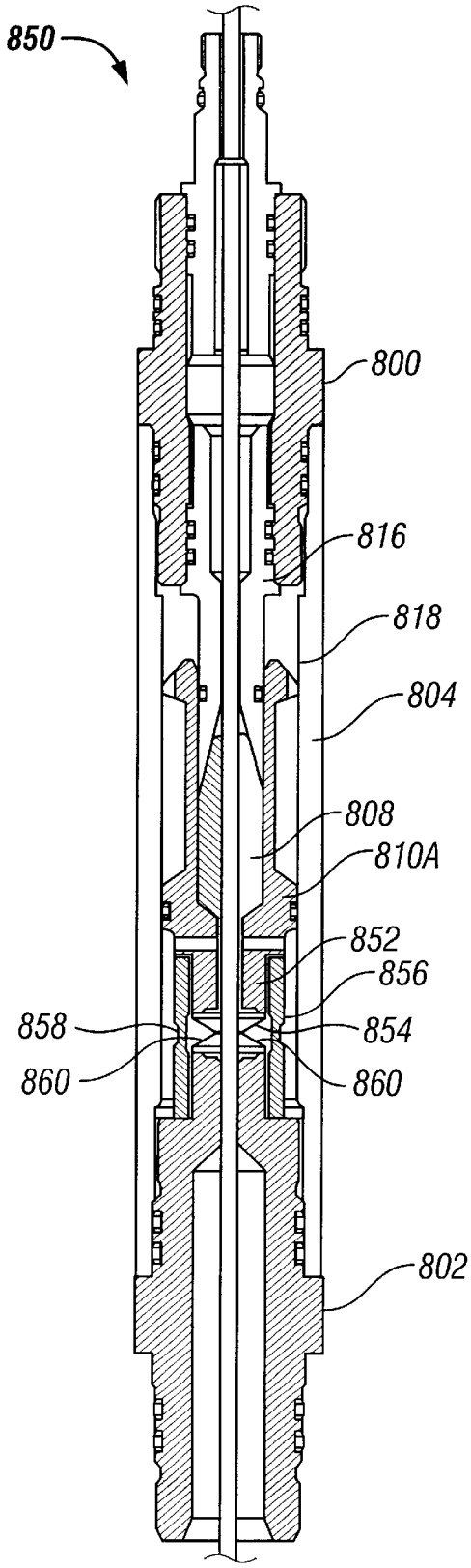

FIG. 20 shows a variation (850) of the barrier mechanism 840 shown in FIG. 18. The barrier mechanism 850 shown in FIG. 20 is the same as the barrier mechanism 840 except for the way in which the plug 808 is maintained in its initial open position. A piston 810A of the barrier mechanism 850 is slightly modified from the piston 810 shown in FIG. 18. As with the piston 810, the piston 810A encloses the plug 808. However, in this embodiment, the piston 810A has an extension 852. The lower end of the extension 852 is in contact with a cutter cartridge 854, which is trapped between the lower end of the piston 810A and the lower adapter 802. The cutter cartridge 854 is located within a mandrel 856. The detonating cord 300 passes through the barrier mechanism 850 and through the cutter cartridge 854.

The mandrel 856 has a thinned section 858. The cutter cartridge 854 includes an explosive that has a portion that is generally conically shaped. The conical shape provides a shaped charge effect in which a perforating jet is formed upon detonation to puncture through the thinned section 858 of the mandrel 856.

Upon detonation of the detonating cord 300, the explosive in the cutter cartridge 854 cuts through the thinned region 858 of the mandrel 856. This collapses the mandrel 856 so that the piston 810A is free to move. The wellbore pressure and the shock wave of detonation build up a differential pressure across the piston 810A with reference to the atmospheric chamber 818. As a result, the piston 810A pushes the fingers of the plug 808 into the bore of the seat 816 so that a plug is formed to prevent fluid communication through the seat 816.

Figure 23:
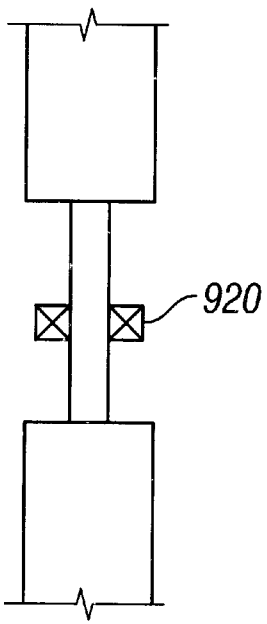
Figure 22:
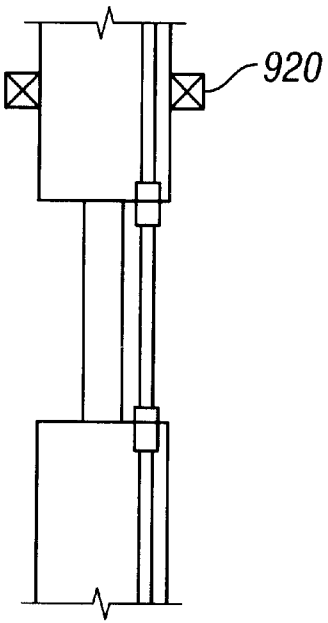
Figure 21:
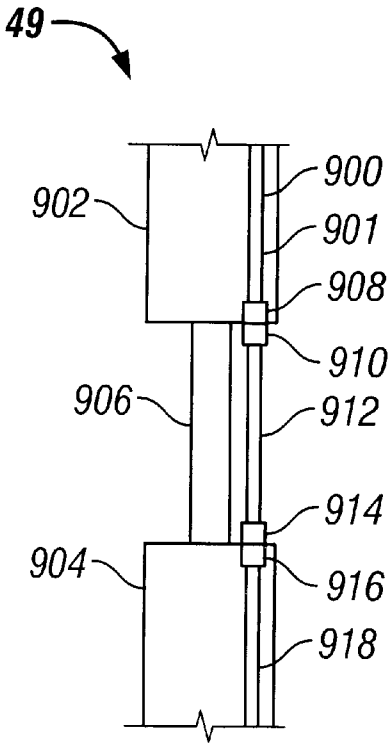

FIGS. 21–23 illustrate yet another different embodiment of a barrier mechanism to block a fluid path after activation of the perforating gun string. In this embodiment, the detonating cord 900 is run along a path that is separate and spaced apart from an inner bore through the main part of the connector assembly 49, which includes an upper section 902, a reduced diameter intermediate section 906 (e.g., a tube), and a lower section 904. A side passageway 901 is provided along a side of the connector assembly 49 (such as through the inner wall of the housing of the connector assembly 49). The inner passageways of the connector assembly 49 in the sections 902, 904, and 906 are sealed against fluid communication. The detonating cord runs through the side passageway 901 to a trigger charge 908, which in turn is positioned in the proximity of a booster charge 910. A tube 912 extends from the booster charge 910 to the second trigger charge 914. The tube 912 carries another segment of the detonating cord 900. A booster charge 916 is placed in the proximity of the trigger charge 914, with another side passageway 918 provided in the lower section 904 to route another segment of the detonating cord 900.

As shown in FIG. 22, when the perforating string is being deployed into the wellbore, a sealing ram 920 is sealed against the upper section 902 of the connector assembly 49 to provide the necessary isolation of wellbore pressure from above the connector assembly 49. After detonation of the detonating cord 900, the tube at 912 is destroyed so that another sealing mechanism can seal around the tube 906 to provide the wellbore pressure isolation. In this manner, isolation of the wellhead pressure is maintained so that the lubricator 54 of the well surface equipment 50 can be maintained at atmospheric or some other low pressure.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method of deploying a tool string, comprising:

inserting a first tool into a wellbore through well surface equipment, the wellbore being at an elevated pressure;

isolating a first portion of the well surface equipment from the elevated wellbore pressure;

connecting a second tool to the first tool in the portion of the well surface equipment that is isolated from the elevated wellbore pressure, the first tool and second tool making up at least part of the tool string, wherein the tool string has an inner bore, and wherein the inner bore is opened to fluid communication in response to activation of the tool string; and providing a barrier mechanism in the tool string to block one portion of the inner bore from another portion of the inner bore to maintain isolation of the first portion of the well surface equipment even after activation of the tool string.

2. The method of claim 1, further comprising actuating the barrier mechanism using a fluid pressure differential created in response to activation of the tool string.

3. The method of claim 2, wherein providing the barrier mechanism comprises providing a barrier mechanism having a valve.

4. The method of claim 3, wherein providing the barrier mechanism comprises providing the barrier mechanism having at least one of a flapper valve, a sliding valve, and a rotating valve.

5. The method of claim 1, further comprising actuating the barrier mechanism by engaging a plug into a passage of a component to block fluid flow through the passage, the passage in a fluid path including the inner bore of the tool string.

6. The method of claim 5, wherein engaging the plug into the passage is accomplished by using a pressure-activated mechanism.

7. The method of claim 5, wherein engaging the plug comprises moving the plug by activating an explosive device.

8. The method of claim 1, wherein providing the barrier mechanism comprises providing a through-bulkhead-initiator assembly.

9. The method of claim 8, further comprising providing detonating cord segments through the inner bore of the tool string, the through-bulkhead-initiator assembly ballistically coupling at least two of the detonating cord segments.

10. The method of claim 1, wherein isolating the first portion of the well surface equipment comprises isolating an inner chamber of a lubricator.

11. The method of claim 1, further comprising providing a connector assembly to connect the first and second tools of the tool string.

12. The method of claim 11, further comprising engaging a seal against an outer surface of the connector assembly to isolate the first portion of the well surface equipment.

13. The method of claim 12, wherein engaging the seal comprises engaging rams against the connector assembly.

14. A system for sealing a fluid flow path of a tool string opened after initiation of an explosive in the fluid flow path, the system comprising:

a housing containing the fluid flow path; and a barrier mechanism located in the housing, the barrier mechanism adapted to be actuated in response to initiation of the tool string to block the fluid flow path.

15. The system of claim 14, wherein the barrier mechanism comprises a pressure-activated actuating mechanism.

16. The system of claim 15, wherein the barrier mechanism comprises a blocking component adapted to be moved to a closed position by the pressure-activated actuating mechanism, the blocking component to block the fluid flow path in the closed position.

17. The system of claim 16, wherein the blocking component comprises a valve.

18. The system of claim 17, wherein the valve is selected from the group consisting of a flapper valve, a sliding valve, and a rotating valve.

19. The system of claim 16, wherein the pressure-activated actuating mechanism comprises a mandrel adapted to be moved by a differential pressure.

20. The system of claim 16, wherein the blocking component comprises a plug and a bore, the pressure-activated actuating mechanism to move the plug into sealing engagement with the bore to block the fluid flow path.

21. The system of claim 14, wherein the barrier mechanism comprises an explosive, a plugging material, and a bore, the explosive to propel the plugging material into the bore to block the fluid flow path.

22. A system for sealing a detonating cord path of a tool subsequent to the detonation of the detonating cord, the system comprising:

a barrier preventing fluid communication through the detonating cord path;

the detonating cord including a first and a second section;

the detonating cord first section disposed on one side of the barrier and the detonating cord second section disposed on the other side of the barrier;

wherein a detonating wave that is carried along the detonating cord is transferred by the barrier from the detonating cord first section to the detonating cord second section without rupturing the barrier.

23. The system of claim 22, further comprising a through-bulkhead-initiator assembly, the barrier being part of the through-bulkhead-initiator assembly.

24. The system of claim 23, wherein the through-bulkhead-initiator assembly further comprises a first explosive on one side of the barrier and a second explosive on the other side of the barrier, the first explosive ballistically connected to the detonating cord first section, and the second explosive ballistically connected to the detonating cord second portion.

25. A system comprising:

a main structure having a first segment with a first diameter and a second segment with a second diameter, the second diameter smaller than the first diameter;

a passage defined in the first segment;

a first detonating cord portion extending through the passage;

a conduit extending from the passage and external to the second segment of the main structure;

a second detonating cord portion extending through the conduit, wherein the conduit is broken apart after initiation of the second detonating cord; and a seal to engage an outer surface of the second segment after the conduit is broken apart to block fluid communication outside the main housing.

26. The system of claim 25, wherein the conduit comprises a tube.

27. The system of claim 25, further comprising at least one explosive charge to ballistically connect the first and second detonating cord portions.

* * * * *